US007746004B2

(12) United States Patent
Kimura et al.

(10) Patent No.: US 7,746,004 B2
(45) Date of Patent: Jun. 29, 2010

(54) DISCHARGE-LAMP LIGHTING APPARATUS

(75) Inventors: Kengo Kimura, Niiza (JP); Yukinari Fukumoto, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 428 days.

(21) Appl. No.: 11/770,280

(22) Filed: Jun. 28, 2007

(65) Prior Publication Data

US 2008/0042586 A1 Feb. 21, 2008

(30) Foreign Application Priority Data

Jul. 7, 2006 (JP) ..... 2006-187691

(51) Int. Cl.
*H05B 37/02* (2006.01)
*H05B 41/36* (2006.01)

(52) U.S. Cl. ..... 315/291; 315/307

(58) Field of Classification Search ..... 315/209 R, 315/209 T, 246, 276, 291, 307, DIG. 7
See application file for complete search history.

(56) References Cited

U.S. PATENT DOCUMENTS 7,368,881 B2 * 5/2008 Suganuma et al. ..... 315/291
7,394,209 B2 * 7/2008 Lin et al. ..... 315/247
7,515,446 B2 * 4/2009 Lin ..... 363/98
7,564,197 B2 * 7/2009 Kimura et al. ..... 315/307

FOREIGN PATENT DOCUMENTS

JP 11-298308 10/1999
JP 2003-164163 6/2003

* cited by examiner

*Primary Examiner*—Douglas W Owens
*Assistant Examiner*—Minh D A
(74) *Attorney, Agent, or Firm*—Oblon, Spivak, McClelland, Maier & Neustadt, L.L.P.

(57) ABSTRACT

A discharge-lamp lighting apparatus includes series circuits connected to each end of a DC power source, a transformer, FETs Qp1, Qn1, Qp2, and Qn2, and a drive circuit. The drive circuit includes transistors Q1 and Q3 to discharge gate-source capacitances of the Qp1 and Qp2, resistance elements to determine gate potentials of the transistors Q1 and Q3 when the transistors Q1 and Q3 are turned on, transistors Q2 and Q4 to charge the gate-source capacitances of the Qp1 and Qp2, constant current circuits, and switches connected in series with the series circuits of the constant current circuits and resistance elements, respectively, to turn on/off the constant current circuits.

4 Claims, 7 Drawing Sheets

DISCHARGE-LAMP LIGHTING APPARATUS

This application is based upon and claims the benefit of priority from Japanese Patent Application No: 2006-187691, filed on Jul. 7, 2006, the entire contents of which are incorporated herein by reference.

BACKGROUND OF THE INVENTION

1. Field of the Invention

The present invention relates to a discharge-lamp lighting apparatus for lighting a discharge lamp, and particularly, to a discharge-lamp lighting apparatus for lighting a cold cathode lamp installed in, for example, a liquid-crystal portable device.

2. Description of the Related Art

Discharge-lamp lighting apparatuses are classified into those employing n-type MOSFETs as high-side switching elements and those employing p-type MOSFETs as high-side switching elements. Liquid-crystal portable devices such as notebook computers employing cold cathode lamps usually use p-type MOSFETs as high-side switching elements because, if n-type MOSFETs are used as high-side switching elements, bootstrap circuits and the like are needed to drive the n-type MOSFETs, to complicate drive circuits and increase cost.

A capacitor boost technique is a simple example of driving a discharge-lamp lighting apparatus employing p-type MOSFETs as high-side switching elements. An example thereof is disclosed in Japanese Unexamined Patent Application Publication No. 2003-164163 shown in FIG. 1. In FIG. 1, first and second series circuits are arranged between a DC power source Vin and the grounding. The first series circuit includes a p-type MOSFET Qp1 serving as a high-side switching element and an n-type MOSFET Qn1 serving as a low-side switching element. The second series circuit includes a p-type MOSFET Qp2 serving as a high-side switching element and an n-type MOSFET Qn2 serving as a low-side switching element. Between a connection point of the p- and n-type MOSFETs Qp1 and Qn1 and a connection point of the p- and n-type MOSFETs Qp2 and Qn2, there is connected a series circuit consisting of a resonance capacitor C3 and a primary winding P of a transformer T. Each end of a secondary winding S of the transformer T is connected to a capacitor C4.

The DC power source Vin is connected to a source of the p-type MOSFET Qp1 (hereinafter referred to as p-type FET Qp1) and a source of the p-type MOSFET Qp2 (hereinafter referred to as p-type FET Qp2). Between the gate and source of the p-type FET Qp1, there is connected a parallel circuit consisting of a diode D1 and a resistor R1. Between the gate and source of the p-type FET Qp2, there is connected a parallel circuit consisting of a diode D2 and a resistor R2. The gate of the p-type FET Qp1 is connected through a capacitor C1 to a terminal PD1 of a control IC 1. The gate of the p-type FET Qp2 is connected through a capacitor C2 to a terminal PD2 of the control IC 1. The gate of the n-type MOSFET Qn1 (hereinafter referred to as n-type FET Qn1) is connected to a terminal ND1 of the control IC 1. The gate of the n-type MOSFET Qn2 (hereinafter referred to as n-type FET Qn2) is connected to a terminal ND2 of the control IC1.

The control IC1 (or a discrete circuit) includes a regulator 11, a frequency divider 13, an error amplifier 15, and an oscillator 17. The regulator 11 receives the DC power source Vin and generates a predetermined voltage Vp.REG, which is supplied to the frequency divider 13. A first end of the secondary winding S of the transformer T is connected to a first electrode of a discharge lamp 3. A second electrode of the discharge lamp 3 is connected to a lamp current detector 5. The lamp current detector 5 detects a current passing through the discharge lamp 3 and provides the error amplifier 15 with a voltage proportional to the detected current. The error amplifier 15 compares the voltage from the lamp current detector 5 with a reference voltage and sends an error voltage to the oscillator 17. The oscillator 17 compares the error voltage with a triangle wave and generates a pulse signal whose width corresponds to the error voltage. When the error voltage is large, the pulse width of the pulse signal is wide, and when the error voltage is small, the pulse width of the pulse signal is narrow.

The frequency divider 13 divides the frequency of the pulse signal from the oscillator 17. Namely, in a first half of a given period, a high-level pulse signal is supplied through the terminals PD1 and ND1 to the p- and n-type FETs Qp1 and Qn1 and a low-level pulse signal is supplied through the terminals PD2 and ND2 to the p- and n-type FETs Qp2 and Qn2. In a second half of the given period, a low-level pulse signal is supplied to the p- and n-type FETs Qp1 and Qn1 and a high-level pulse signal is supplied to the p- and n-type FETs Qp2 and Qn2. This results in alternating an ON-period in which the p-type FET Qp1 and n-type FET Qn2 are simultaneously turned on and an ON-period in which the p-type FET Qp2 and n-type FET Qn1 are simultaneously turned on.

Operation of the discharge-lamp lighting apparatus of FIG. 1 will be explained with reference to a timing chart of FIG. 2. At time t2, the p- and n-type FETs Qp1 and Qn2 are turned on to pass a current from the DC power source Vin along a route consisting of Qp1, C3, P, and Qn2, to apply a voltage to the capacitor C3 and the primary winding P of the transformer T. As a result, the capacitor C3 and an inductance of the primary winding P of the transformer T cause resonance to produce a sinusoidal wave current. The secondary winding S of the transformer T then generates a voltage to pass a current to the discharge lamp 3, thereby turning on the discharge lamp 3.

At time t3, the p- and n-type FETs Qp2 and Qn1 are turned on to pass a current from the DC power source Vin along a route consisting of Qp2, P, C3, and Qn1, to reversely apply a voltage to the capacitor C3 and the primary winding P of the transformer T. As a result, the secondary winding S of the transformer T generates a high sinusoidal wave voltage of opposite phase, to turn on the discharge lamp 3.

If the input voltage Vin suddenly varies due to, for example, the insertion or removal of an adaptor, the related art of FIG. 1 increases the gate-source voltage of each of the p-type FETs Qp1 and Qp2 without regard to the levels of drive signals from the terminals PD1 and PD2 and turns on the p-type FETs Qp1 and Qp2. As a result, a bridge circuit consisting of the four FETs Qp1, Qn1, Qp2, and Qn2 passes a shoot-through (short-circuit) current to break the p-type FETs Qp1 and Qp2. For example, if the input voltage Vin suddenly increases, charge currents pass through the capacitors C1 and C2, to increase the terminal voltages of the resistors R1 and R2, i.e., the gate-source voltages of the p-type FETs Qp1 and Qp2, thereby turning on the p-type FETs Qp1 and Qp2.

To cope with this problem, a bipolar totem pole technique is used to drive p-type FETs serving as high-side switching elements. FIG. 3 shows a discharge-lamp lighting apparatus disclosed in Japanese Unexamined Patent Application Publication No. 11-298308 employing the totem pole technique. FIG. 4 is a timing chart showing signals at various parts in the apparatus of FIG. 3. The apparatus of FIG. 3 has a control IC 1*a* that differs from the control IC1 of FIG. 1 in drivers for driving p-type FETs Qp1 and Qp2. In FIG. 3, the driver for driving the p-type FET Qp1 includes transistors Q1 to Q4 and resistors R0 to R4 and the driver for driving the p-type FET Qp2 includes transistors Q5 to Q8 and resistors R5 to R9.

If an input voltage Vin suddenly increases in FIG. 3, a voltage from the resistor R1 turns on the transistor Q1 to substantially zero the gate-source voltage of the p-type FET Qp1. Similarly, a voltage from the resistor R6 turns on the transistor Q5 to substantially zero the gate-source voltage of the p-type FET Qp2. Since the p-type FETs Qp1 and Qp2 are OFF, no shoot-through current passes through a bridge circuit.

SUMMARY OF THE INVENTION

According to the related art shown in FIG. 3, a gate-source voltage VPGS of the p-type FET Qp1 with a drive signal from a terminal PD1 being low is determined as follows:

$$VPGS \approx \{R1/(R1+R2)\} \times Vin - VBE(Q2)$$

Namely, the gate-source voltage VPGS of the p-type FET Qp1 (Qp2) is largely dependent on the input voltage Vin. In a notebook computer, for example, the input voltage Vin varies between about 7V and about 22V, to greatly vary the gate-source voltage VPGS of the p-type FET. If the input voltage Vin is low, a gate voltage to the p-type FET will be insufficient to turn on/off the p-type FET, or will increase ON-resistance to produce heat.

If the input voltage Vin is high, the gate-source voltage of the p-type FET will increase to reactively charge and discharge a capacitance between the gate and source of the p-type FET, thereby deteriorating efficiency. In the worst case, the input voltage will exceed the gate-source withstand voltage of the p-type FET and break the p-type FET. To cope with this problem, a zener diode, for example, must be arranged to clamp the gate-source voltage of the p-type FET.

According to the present invention, a discharge-lamp lighting apparatus capable of preventing a p-type FET from breaking even if an input voltage suddenly varies and securing high efficiency for a wide range of input voltage variations can be provided.

According to a first technical aspect of the present invention, provided is a discharge-lamp lighting apparatus including a first series circuit connected to each end of a DC power source and having a high-side first p-type FET and a low-side first n-type FET that are connected in series; a second series circuit connected to each end of the DC power source and having a high-side second p-type FET and a low-side second n-type FET that are connected in series; a transformer having a primary winding and a secondary winding, the primary winding forming, with a capacitor, a series circuit that is connected between a connection point of the first p- and n-type FETs and a connection point of the second p- and n-type FETs, the secondary winding being connected to a discharge lamp; a control circuit configured to alternately turn on/off the first p-type FET and second n-type FET and the first n-type FET and second p-type FET by providing the FETs with control signals according to a lamp current passed to the discharge lamp; and a first drive circuit configured to drive the first p-type FET and a second drive circuit configured to drive the second p-type FET. Each of the first and second drive circuits includes a first switch element configured to, when turned on, discharge a gate-source capacitance of the corresponding p-type FET and thereby turn off the p-type FET in question; a resistance element having one end connected to the DC power source, configured to determine the potential of a control terminal of the first switch element when the first switch element is turned on; a second switch element configured to, when turned on, charge the gate-source capacitance of the corresponding p-type FET and thereby turn on the p-type FET in question; a constant current circuit connected in series with the resistance element; and a switch connected in series with the series circuit of the constant current circuit and resistance element, configured to turn on/off the constant current circuit under the control of the control circuit.

According to a second technical aspect of the present invention, provided is a discharge-lamp lighting apparatus including a first series circuit connected to each end of a DC power source and including a high-side p-type FET and a low-side n-type FET that are connected in series; a transformer having a primary winding and a secondary winding, the primary winding being connected to a connection point of the p- and n-type FETs and to a connection point that is connected through a capacitor to at least one end of the DC power source, the secondary winding being connected to a discharge lamp; a control circuit configured to alternately turn on/off the p- and n-type FETs according to a lamp current passed to the discharge lamp; and a drive circuit configured to drive the p-type FET. The drive circuit includes a first switch element configured to, when turned on, discharge a gate-source capacitance of the p-type FET and thereby turn off the p-type FET; a resistance element having one end connected to the DC power source, configured to determine the potential of a control terminal of the first switch element when the first switch element is turned on; a second switch element configured to, when turned on, charge the gate-source capacitance of the p-type FET and thereby turn on the p-type FET; a constant current circuit connected in series with the resistance element; and a switch connected in series with the series circuit of the constant current circuit and resistance element, configured to turn on/off the constant current circuit under the control of the control circuit.

According to any one of the aspects of the present invention, the switch is turned on in response to a control signal, to pass a constant current from the constant current circuit through the resistance element. The resistance element provides a constant terminal voltage that is determined by the product of the resistance of the resistance element and the constant current. The constant terminal voltage is a fixed voltage unaffected by the level of an input voltage. Accordingly, even if the input voltage suddenly changes, the p-type FET (s) will never be broken and high efficiency is secured for a wide range of input variations.

DESCRIPTION OF THE PREFERRED EMBODIMENTS

Discharge-lamp lighting apparatuses according to embodiments of the present invention will be explained in detail with reference to the accompanying drawings.

First Embodiment

Figure 1:
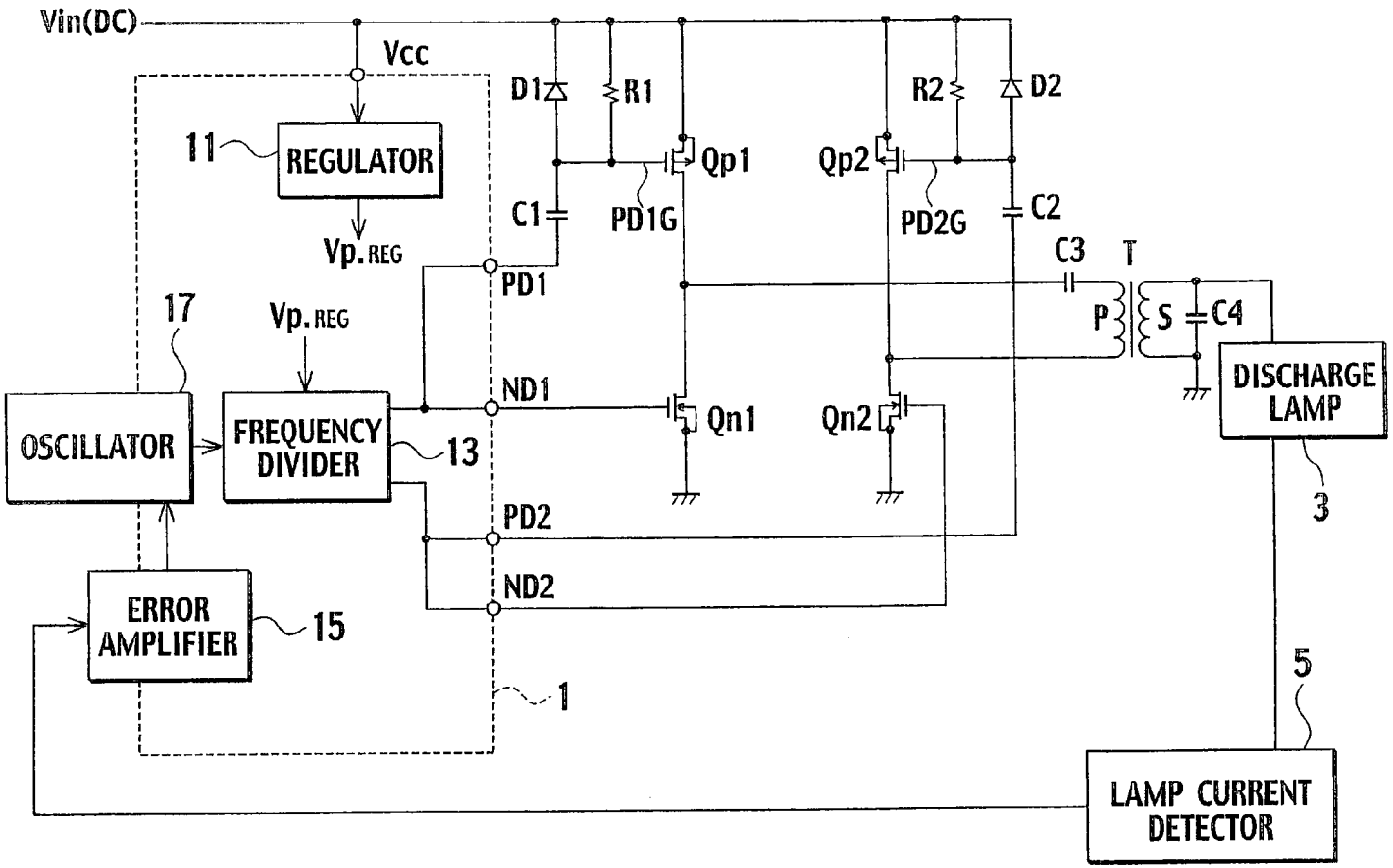
FIG. 1 PRIOR ART
FIG. 1 is a circuit diagram showing a discharge-lamp lighting apparatus according to a related art.
Figure 2:
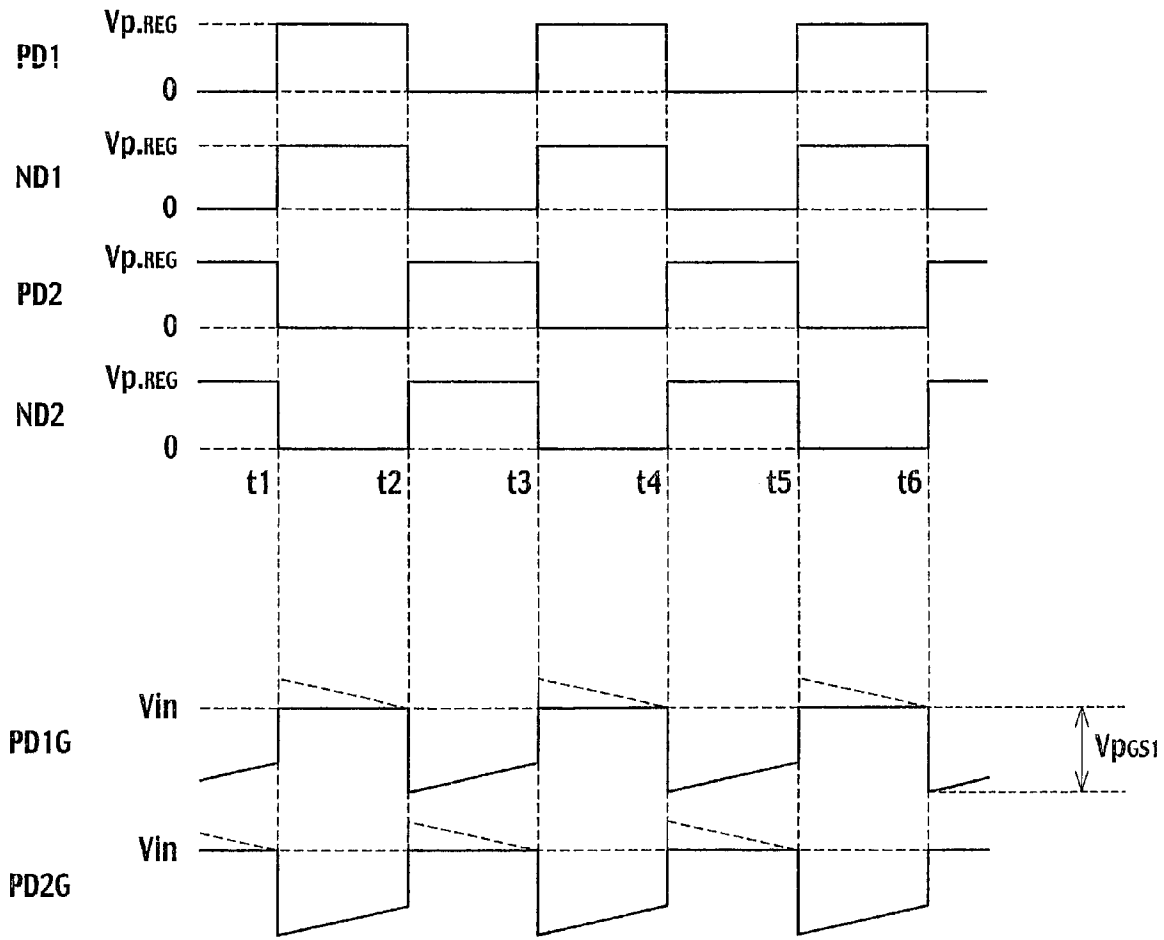
FIG. 2 PRIOR ART
FIG. 2 is a timing chart showing signals at various parts in the apparatus of FIG. 1.
Figure 3:
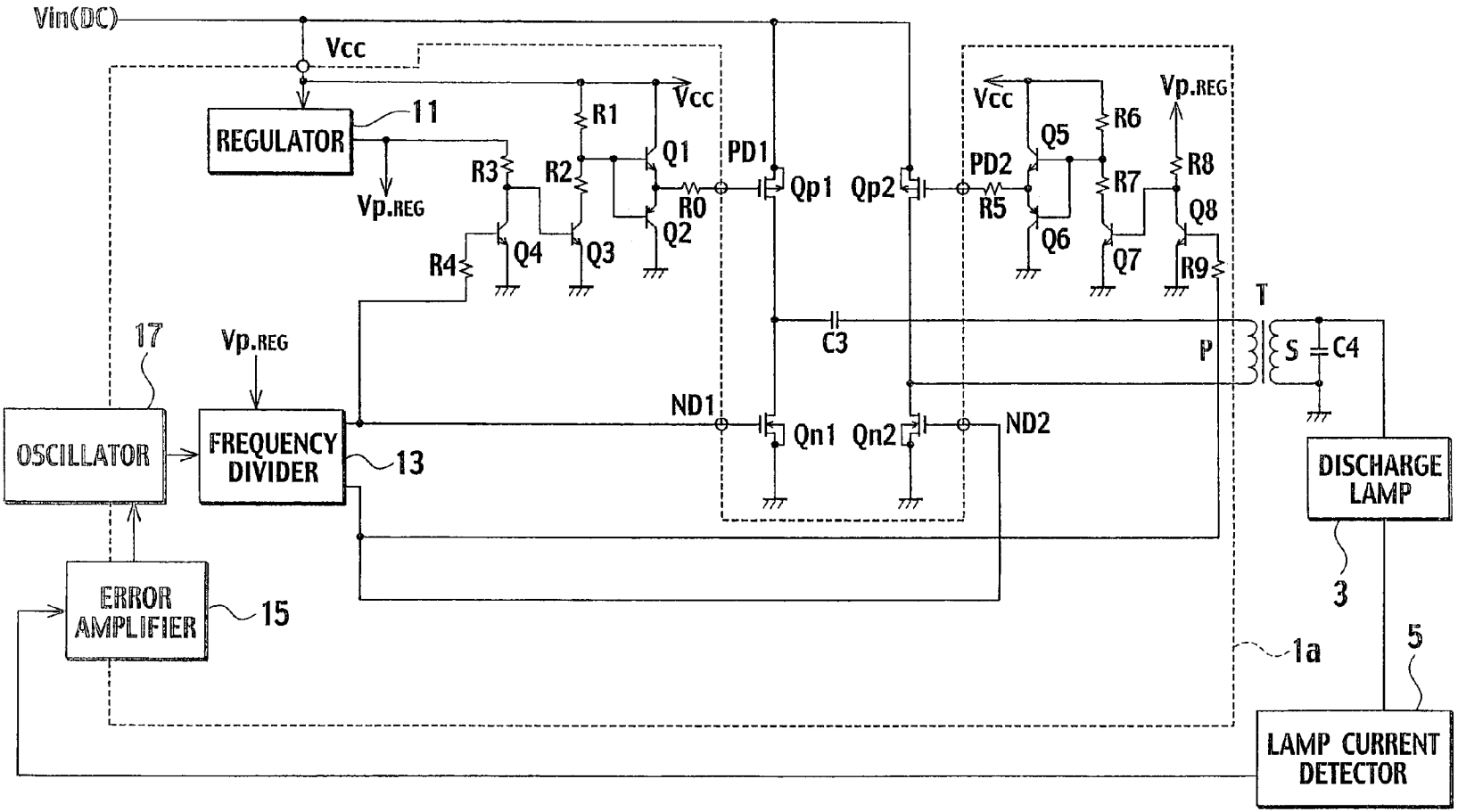
FIG. 3 PRIOR ART
FIG. 3 is a circuit diagram showing a discharge-lamp lighting apparatus according to another related art.
Figure 4:
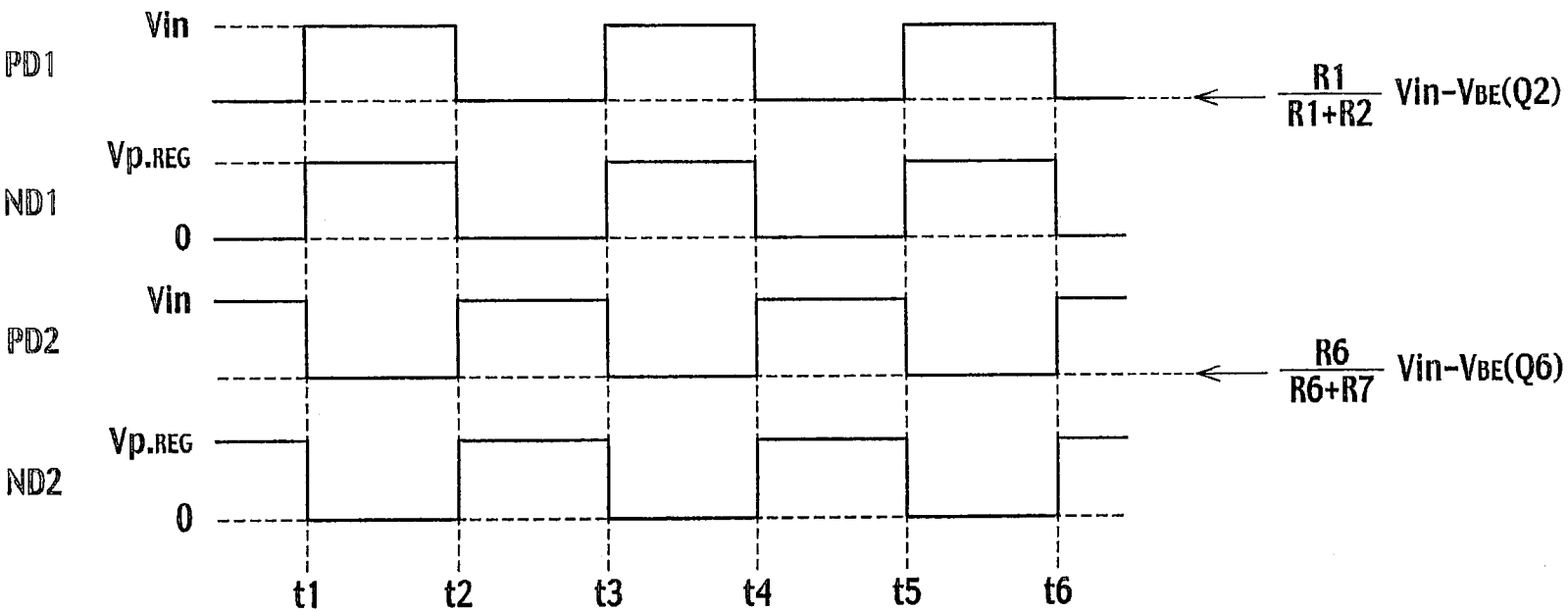
FIG. 4 PRIOR ART
FIG. 4 is a timing chart showing signals at various parts in the apparatus of FIG. 3.
Figure 5:
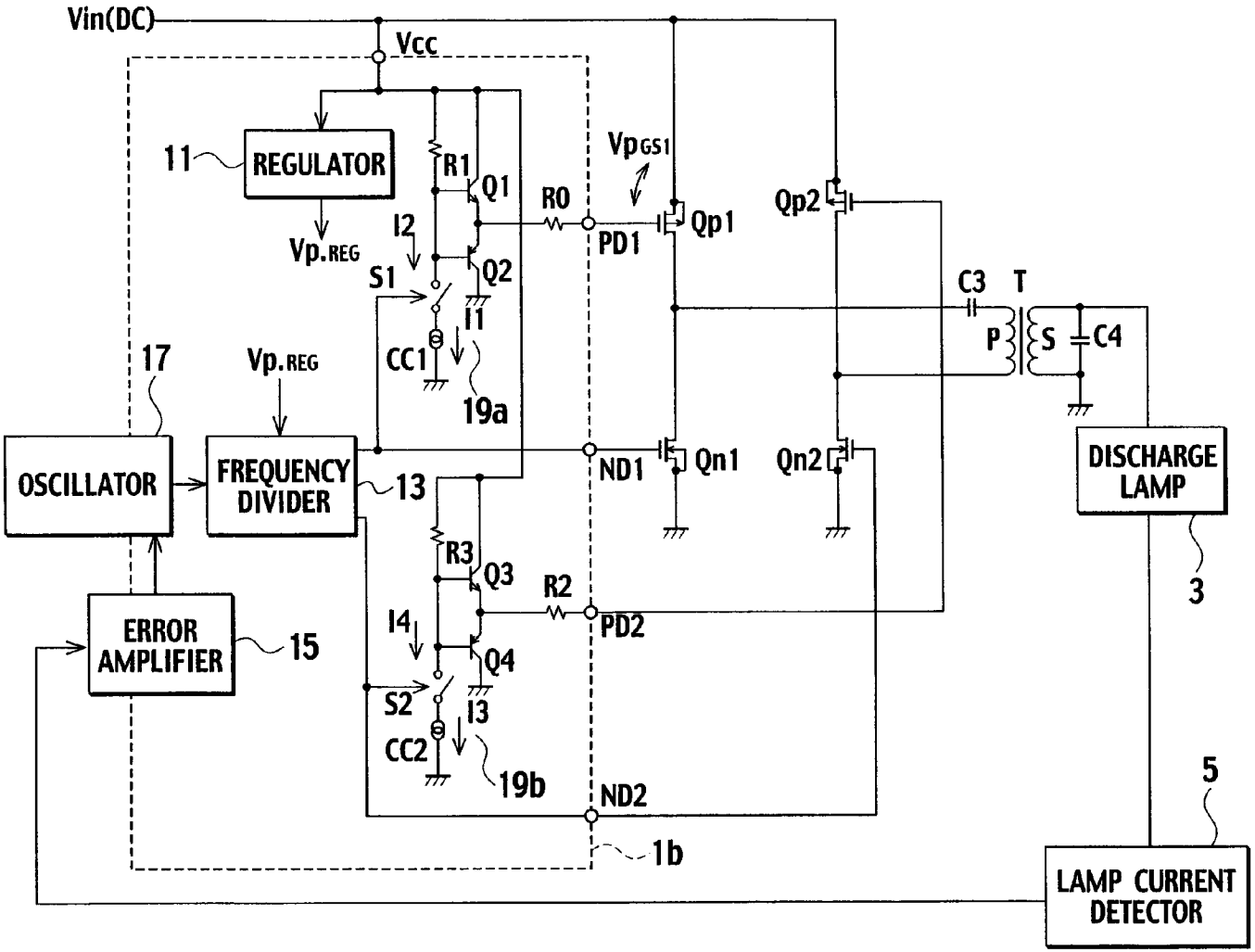
FIG. 5 is a circuit diagram showing a discharge-lamp lighting apparatus according to a first embodiment of the present invention.

FIG. 5 is a circuit diagram showing a discharge-lamp lighting apparatus according to the first embodiment of the present invention. In the embodiment of FIG. 5, with respect to the apparatus of FIG. 1, the resistor R1, diode D1, and capacitor C1 connected to the p-type FET Qp1 of FIG. 1 are removed, and also the resistor R2, diode D2, and capacitor C2 connected to the p-type FET Qp2 of FIG. 1 are removed. In addition, the embodiment of FIG. 5 employs drive circuits 19*a* and 19*b* in a control IC 1*b*. The other parts of the embodiment of FIG. 5 are the same as those of the related art of FIG. 1, and therefore, are represented with the same reference marks to omit their explanations. The parts that are different from those of the related art will be explained.

The drive circuit 19*a* drives a p-type FET Qp1. The drive circuit 19*a* includes (i) a transistor Q1 configured to discharge a gate-source capacitance of the p-type FET Qp1 to turn off the p-type FET Qp1 as being turned on, (ii) a resistor R1 that is connected to a DC power source Vin at one end thereof and serves as an impedance element to determine a base potential of the transistor Q1 when the transistor Q1 is turned on, (iii) a transistor Q2 configured to charge the gate-source capacitance of the p-type FET Qp1 to turn on the p-type FET Qp1 as being turned on, (iv) a constant current circuit CC1 that is connected in series with the resistor R1 and passes a constant current, and (v) a switch S1 that is connected in series with a series circuit of the constant current circuit CC1 and resistor R1 and turns on/off the constant current circuit CC1 in response to a first control signal from a frequency divider 13.

The switch S1 (S2) turns off in response to a high-level input signal. The switch may be a semiconductor switch having a constant current characteristic. In this case, the semiconductor switch may serve as both the switch S1 (S2) and constant current circuit CC1 (CC2). The switch S2 operates in the same manner. For example, the semiconductor switch may be a MOSFET. In this case, the gate of the MOSFET is clamped at a predetermined voltage, and a source resistance is inserted to provide a constant current determined by "(VG−Vth)/Rs" where VG is the gate clamp voltage, Vth a gate-source voltage, and Rs the source resistance.

The transistor Q1 is of an npn-type and has a collector connected to a positive electrode of the power source Vin. The transistor Q2 is of a pnp-type and has a collector connected to the ground. Emitters of the transistors Q1 and Q2 are connected to each other, and a connection point between them is connected through a resistor R0 to the gate of the p-type FET Qp1. Bases of the transistors Q1 and Q2 are connected to each other. Between the collector and base of the transistor Q1, there is connected the resistor R1. Between the collector and base of the transistor Q2, there is connected a series circuit of the constant current circuit CC1 and switch S1. The first control signal from the frequency divider 13 is also applied to the gate of an n-type FET Qn1.

The drive circuit 19*b* drives a p-type FET Qp2. In the similar manner to the drive circuit 19*a*, the drive circuit 19*b* includes (i) a transistor Q3 configured to discharge a gate-source capacitance of the p-type FET Qp2 to turn off the p-type FET Qp2 as being turned on, (ii) a resistor R3 that is connected to the DC power source Vin at one end thereof and serves as an impedance element to determine a base potential of the transistor Q3 when the transistor Q3 is turned on, (iii) a transistor Q4 configured to charge the gate-source capacitance of the p-type FET Qp2 to turn on the p-type FET Qp2 as being turned on, (iv) a constant current circuit CC2 that is connected in series with the resistor R3 and passes a constant current, and (v) a switch S2 that is connected in series with a series circuit of the constant current circuit CC2 and resistor R3 and turns on/off the constant current circuit CC2 in response to a second control signal from the frequency divider 13.

The transistor Q3 is of an npn-type and has a collector connected to the positive electrode of the power source. The transistor Q4 is of a pnp-type and has a collector connected to the grounding. Emitters of the transistors Q3 and Q4 are connected to each other, and a connection point between them is connected through a resistor R2 to the gate of the p-type FET Qp2. Bases of the transistors Q3 and Q4 are connected to each other. Between the collector and base of the transistor Q3, there is connected the resistor R3. Between the collector and base of the transistor Q4, there is connected a series circuit of the constant current circuit CC2 and switch S2. The second control signal from the frequency divider 13 is also applied to the gate of an n-type FET Qn2.

Figure 6:
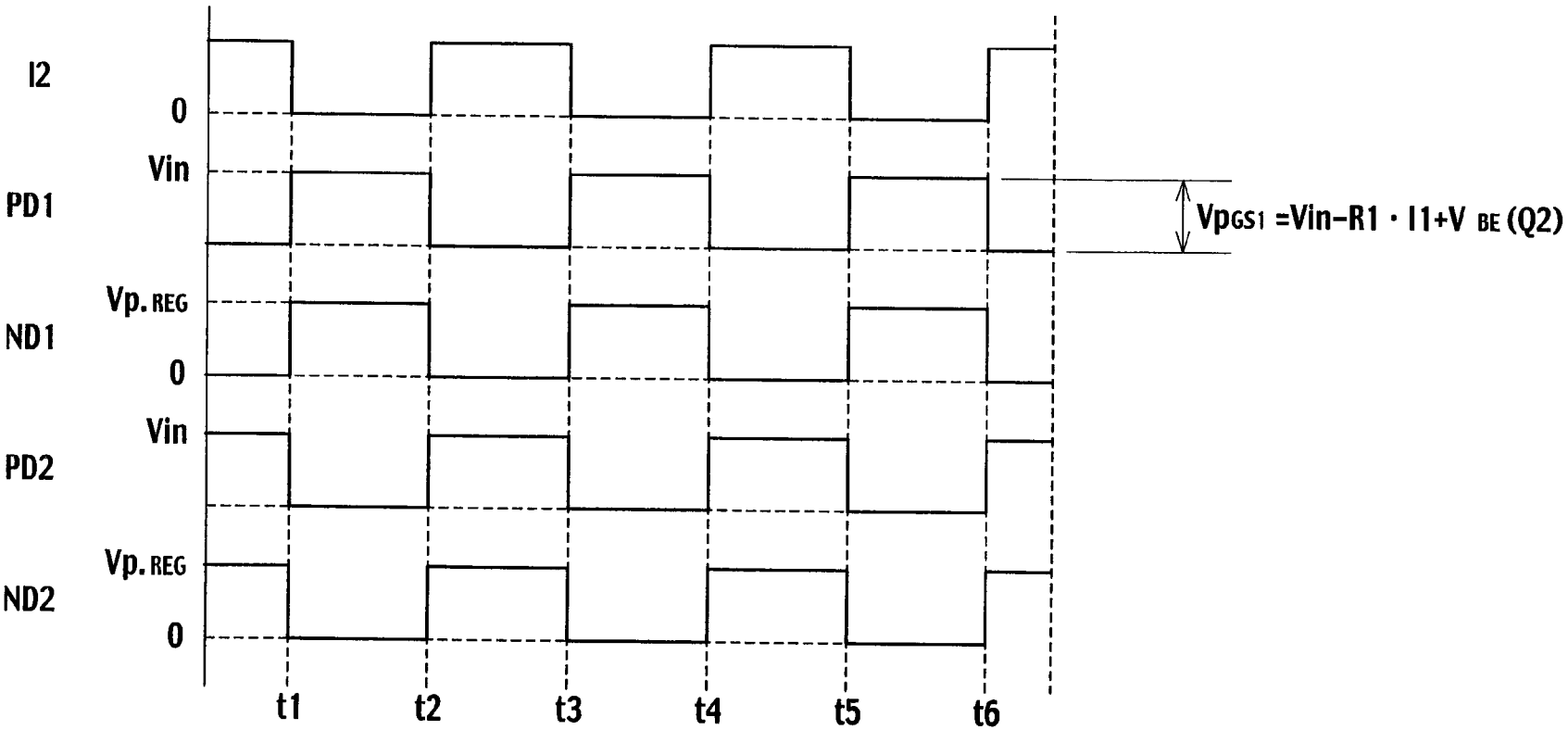
FIG. 6 is a timing chart showing signals at various parts in the apparatus of FIG. 5.

Operation of the discharge-lamp lighting apparatus according to the first embodiment will be explained. FIG. 6 is a timing chart showing signals at various parts in the apparatus of the first embodiment.

At time t2, the switch S1 turns on and the n-type FET Qn1 turns off, in response to the first control signal of low level supplied from the frequency divider 13 to a control terminal of the switch S1 and the gate of the n-type FET Qn1.

When the switch S1 turns on, a constant current I1 provided by the constant current circuit CC1 passes through the resistor R1. Namely, a current I2 passing through the resistor R1 becomes equal to I1, and a terminal voltage of the resistor R1 between the terminals thereof will be a constant voltage VR1 determined by the product of the resistance of the resistor R1 and the current I1.

The terminal voltage VR1 of the resistor R1 is constant without regard to the level of the input voltage Vin. Namely, even if the input voltage Vin suddenly changes, the current passing through the resistor R1 is the constant current I1 from the constant current circuit CC1, and therefore, the terminal voltage VR1 of the resistor R1 is constant (VR1=R1×I1) irrespective of the level of the input voltage Vin.

As a result, a source-gate voltage VPGS1 of the p-type FET Qp1 will be a constant voltage determined by the sum of the terminal voltage VR1 of the resistor R1 and a base-emitter voltage Vbe1 of the transistor Q1. By setting the source-gate voltage VPGS1 of the p-type FET Qp1 to be greater than a pinch-off voltage of the p-type FET Qp1 and smaller than a specified maximum value for the source-gate voltage, the p-type FET Qp1 can safely and surely be turned on/off without regard to the input voltage Vin. The p-type FET Qp1 is turned on in response to a low-level signal from a terminal PD1.

At time t2, the switch S2 turns off and the n-type FET Qn2 turns on in response to a high-level second control signal supplied from the frequency divider 13 to a control terminal of the switch S2 and the gate of the n-type FET Qn2.

When the switch S2 turns off, a constant current I3 provided by the constant current circuit CC2 passing through the resistor R3 is cut off. There will be only base currents of the transistors Q3 and Q4 that are substantially zero. As a result, a terminal voltage of the resistor R3 will nearly be zero, and therefore, a source-gate voltage VPGS2 of the p-type FET Qp2 becomes nearly zero. In response to a high-level signal from a terminal PD2, the p-type FET Qp2 turns off. Then, a current provided by the DC power source Vin passes through a path extending along Qp1, C3, P, and Qn2 to light the discharge lamp 3.

At time t3, the second control signal from the frequency divider 13 to the control terminal of the switch S2 and the gate of the n-type FET Qn2 becomes low to turn on the switch S2 and off the n-type FET Qn2. When the switch S2 turns on, the p-type FET Qp2 turns on in a manner similar to that when the switch S1 turns on. When the first control signal from the frequency divider 13 to the control terminal of the switch S1 and the gate of the n-type FET Qn1 becomes high, the switch S1 turns off and the n-type FET Qn1 turns on. At this time, the p-type FET Qp1 turns off. As a result, a current provided by the DC power source Vin passes through a path extending along Qp2, P, C3, and Qn1 to light the discharge lamp 3.

In this way, the discharge-lamp lighting apparatus according to the first embodiment never increases the gate-source voltage of any one of the high-side p-type FETs Qp1 and Qp2. Without regard to the voltage of the DC power source Vin, the gate-source voltage VPGS of any one of the high-side p-type FETs Qp1 and Qp2 is fixed when a corresponding one of the terminals PD1 and PD2 provides a low-level drive signal. Consequently, the p-type FETs Qp1 and Qp2 will never be broken, and the apparatus of the first embodiment can secure high efficiency for a wide range of input variations.

The drive circuits 19*a* and 19*b*, error amplifier 15, oscillator 17, and frequency divider 13 are integrated into the control IC 1*b*, so that the one-package IC may drive all of the MOSFETs Qp1, Qp2, Qn1, and Qn2. This makes circuit designing easier and the lighting apparatus more compact and inexpensive.

Second Embodiment

Figure 7:
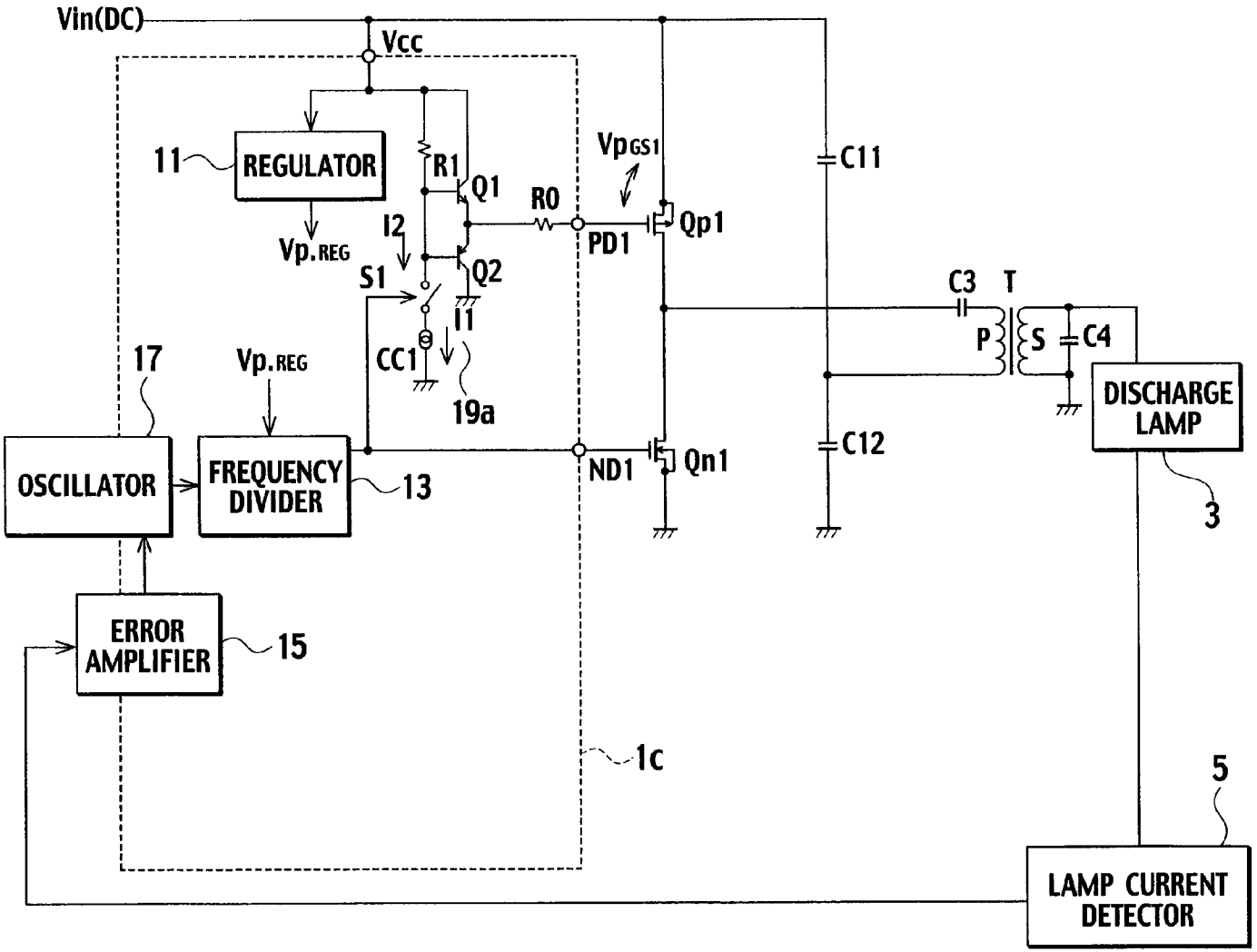
FIG. 7 is a circuit diagram showing a discharge-lamp lighting apparatus according to a second embodiment of the present invention.

FIG. 7 is a circuit diagram showing a discharge-lamp lighting apparatus according to the second embodiment of the present invention. Unlike the first embodiment shown in FIG. 5 that employs a full-bridge architecture, the second embodiment shown in FIG. 7 employs a half-bridge architecture. In the second embodiment, with respect to the apparatus of FIG. 5, the p-type FET Qp2 and n-type FET Qn2 of FIG. 5 is replaced with capacitors C11 and C12, respectively, and the drive circuit 19*b* of FIG. 5 is removed. Only the operation of the drive circuit 19*a* for driving the p-type FET Qp1 and n-type FET Qn1 of the first embodiment of FIGS. 5 and 6 is applicable to the second embodiment of FIG. 7. Namely, the operation of a drive circuit 19*a* of the second embodiment shown in FIG. 7 is the same as that of the first embodiment shown in FIG. 5. The half-bridge architecture of the second embodiment is simple.

According to the second embodiment, an end of a primary winding P of a transformer T is connected to a middle point between the capacitors C11 and C12. The capacitors C11 and C12 may be omitted, so that the end of the primary winding P of the transformer T is directly connected to a power source Vin or the grounding. Alternatively, a capacitor C3 may be omitted, and a combined capacitance of the capacitors C11 and C12 may be equalized to the capacitance of the capacitor C3.

This application claims benefit of priority under 35 USC §119 to Japanese Patent Applications No. 2006-187691, filed on Jul. 7, 2006, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A discharge-lamp lighting apparatus comprising:

a first series circuit connected to each end of a DC power source and including a high-side first p-type FET and a low-side first n-type FET that are connected in series;

a second series circuit connected to each end of the DC power source and including a high-side second p-type FET and a low-side second n-type FET that are connected in series;

a transformer having a primary winding and a secondary winding, a series circuit of the primary winding and a capacitor being connected between a connection point of the first p- and n-type FETs and a connection point of the second p- and n-type FETs, and the secondary winding being connected to a discharge lamp;

a control circuit configured to alternately turn on/off the first p-type FET and second n-type FET and the first n-type FET and second p-type FET by providing the FETs with control signals according to a lamp current passed through the discharge lamp; and a first drive circuit configured to drive the first p-type FET and a second drive circuit configured to drive the second p-type FET, each of the first and second drive circuits including:

a first switch element configured to discharge a gate-source capacitance of the corresponding p-type FET as being turned on and thereby turn off the p-type FET;

a resistance element having one end connected to the DC power source, configured to determine the potential of a control terminal of the first switch element as the first switch element is turned on;

a second switch element configured to charge the gate-source capacitance of the corresponding p-type FET as being turned on and thereby turn on said corresponding p-type FET;

a constant current circuit connected in series with the resistance element; and a switch connected in series with the series circuit of the constant current circuit and resistance element, configured to turn on/off the constant current circuit under the control of the control circuit.

2. The apparatus of claim 1, wherein the drive circuits and control circuit are arranged in an integrated circuit.

3. A discharge-lamp lighting apparatus comprising:

a first series circuit connected to each end of a DC power source (Vin) and including a high-side p-type FET and a low-side n-type FET that are connected in series;

a transformer having a primary winding and a secondary winding, the primary winding being connected to a connection point of the p- and n-type FETs and to a connection point that is connected through a capacitor to at least one end of the DC power source, and the secondary winding being connected to a discharge lamp;

a control circuit configured to alternately turn on/off the p- and n-type FETs according to a lamp current passed through the discharge lamp; and a drive circuit configured to drive the p-type FET, the drive circuit including:

a first switch element configured to, when turned on, discharge a gate-source capacitance of the p-type FET and thereby turn off said p-type FET;

a resistance element having one end connected to the DC power source, configured to determine the potential of a control terminal of the first switch element when the first switch element is turned on;

a second switch element configured to charge the gate-source capacitance of the p-type FET as being turned on and thereby turn on said p-type FET;

a constant current circuit connected in series with the resistance element; and a switch connected in series with the series circuit of the constant current circuit and resistance element, configured to turn on/off the constant current circuit under the control of the control circuit.

4. The apparatus of claim 3, wherein the drive circuit and control circuit are arranged in an integrated circuit.

* * * * *